US010179395B2

(12) United States Patent
Hsieh

(10) Patent No.: US 10,179,395 B2
(45) Date of Patent: Jan. 15, 2019

(54) COLLAPSIBLE TORQUE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 267 days.

(21) Appl. No.: 15/143,340

(22) Filed: Apr. 29, 2016

(65) Prior Publication Data

US 2016/0243686 A1 Aug. 25, 2016

Related U.S. Application Data

(63) Continuation-in-part of application No. 13/931,842, filed on Jun. 29, 2013, now Pat. No. 9,452,517.

(51) Int. Cl.
*B25B 13/46* (2006.01)
*B25B 23/142* (2006.01)

(52) U.S. Cl.
CPC ..... *B25B 23/1427* (2013.01); *B25B 13/462* (2013.01)

(58) Field of Classification Search
CPC . B25B 23/1427; B25B 13/463; B25B 23/141; B25B 23/14; B25B 13/461; B25B 13/481; B25B 17/02; B25B 13/46; B25B 13/462
See application file for complete search history.

(56) References Cited

U.S. PATENT DOCUMENTS 2,205,501 A * 6/1940 Sunnen ..... B25B 23/1427 81/124.6
2,617,458 A * 11/1952 Kelly ..... B25B 5/12 269/221
2,732,747 A 1/1956 Livermont
2005/0160885 A1* 7/2005 Lai ..... B25B 23/1425 81/429

FOREIGN PATENT DOCUMENTS

| | | |
|---|---|---|
| GB | 1281020 | 7/1972 |
| GB | 2514922 | 5/2015 |
| WO | 9404321 | 3/1994 |

OTHER PUBLICATIONS

Norbar Torque Tools, 2005, pp. 1-3.*

* cited by examiner

*Primary Examiner* — Robert J Scruggs
(74) *Attorney, Agent, or Firm* — Guice Patents PLLC

(57) ABSTRACT

A collapsible torque wrench includes: a shank having a drive head at a front end and two pivoted ends at a rear end; a connection rod, a front end of which being pivotally connected with the first pivoted end; a housing having a tubular body and a casing fixedly disposed on one side of the tubular body, the connection rod being relatively slidably fitted in the tubular body; a torque adjustment mechanism being mounted in the tubular body and including a fixing block, the fixing block being mounted in the tubular body by a plurality of pins; and a stop member received in the casing. A front end of the stop member is pivotally connected with the second pivoted end. The fixing block is easily demounted from the tubular body for replacement.

7 Claims, 11 Drawing Sheets

COLLAPSIBLE TORQUE WRENCH

This application is a Continuation-in-Part of application Ser. No. 13/931,842, entitled COLLAPSIBLE TORQUE WRENCH, filed on Jun. 29, 2013.

BACKGROUND OF THE INVENTION

1. Field of the Invention

The present invention relates generally to a torque wrench, and more particularly to a collapsible torque wrench.

2. Description of the Related Art

A conventional torque wrench generally has torque setting function. In the case that the wrenching torque applied by the wrench to a threaded member exceeds the set value, a warning effect is created to warn a user to stop wrenching.

FIGS. 1 to 3 show a conventional torque wrench 10. The torque wrench 10 includes a shank 12. A drive head 14 is disposed at a front end of the shank 12 for connecting with a socket or fitting onto a threaded member. A rear end of the shank 12 is a pivoted end 13. A branch bar 15 is disposed on one side of the shank 12. The torque wrench 10 further includes a connection rod 16. A front end of the connection rod 16 is pivotally connected with the pivoted end 13 of the shank 12 via a pivot pin 161. The torque wrench 10 further includes a housing including a tubular body 171 and a casing 18 fixedly disposed on one side of the tubular body. The connection rod 16 is fitted in the tubular body 17. A stop member 20 is mounted in the casing 18. A front end of the stop member 20 is pivotally connected with the branch bar 15 via a pivot pin 201, whereby the stop member 20 is angularly displaceable. The body of the stop member 20 is formed with an arched locating slot 21. A rivet 22 is riveted on the casing 18 and positioned in the locating slot 21 of the stop member 20. The torque wrench 10 further includes a torque adjustment mechanism 24 mounted in the tubular body 17. The torque adjustment mechanism 24 includes a hollow fixing block 25, an elastic member 26 and an adjustment member 28. A slender rod section 162 of the connection rod 16 extends through the fixing block 25. The fixing block 25 is fixed in the tubular body 17 without possibility of move. The adjustment member 28 is screwed with the rear end of the slender rod section 162 of the connection rod 16 and partially protrudes from the rear end of the tubular body 17. The elastic member 26 is mounted in the tubular body 17. Two ends of the elastic member 26 respectively abut against the fixing block 25 and the adjustment member 28.

The necessary torque of the wrench is resettable by means of rotating the adjustment member 28. In use, a user can hold the handle 29 to rotate the wrench 10 in a direction of arrow F, whereby the drive head 14 can wrench a threaded member. In operation, the stop member 20 is angularly displaced. At this time, the housing (including the tubular body 17 and the casing 18) will slide toward the rear end of the connection rod 16 and the fixing block 25 is displaced along with the tubular body 17 to compress the elastic member 26. When the force applied by the wrench reaches the set torque, the housing and the relevant components (including the connection rod 16 and the stop member 20) will swing to one side of the wrench around the pivot pins 161, 201 and the rivet 22 is moved to the other end of the locating slot 21 of the stop member 20. In appearance, the shank 12 is bent from the housing to make the user realize that the applied force has reached the set value and stop wrenching.

It is found that the above torque wrench 10 has some shortcomings in structure and needs to be improved. These shortcomings exist because of the manner in which the fixing block 25 is fixed. In the conventional structure, the tubular body 17 is pressed with multiple recessed stripes 171 for fixing the fixing block 25. According to such fixing manner, the fixing block 25 is likely to deform. In the case of deformation of the fixing block 25, the frictional force between the fixing block and the slender rod section 162 of the connection rod 16 will increase. This will affect the smoothness of operation of the mechanism and deteriorate the precision of the torque value of the wrench.

Moreover, according to the above fixing manner of the conventional structure, it is impossible to separate the fixing block 25 from the tubular body 17 and reassemble the two components. As a result, the component cannot be independently replaced. Incase of damage, it is necessary to replace the entire mechanism. For example, in case of damage of the fixing block 25, the damaged fixing block cannot be solely replaced and it is necessary to replace the fixing block as well as the housing. The rivet 22 for locating the stop member 20 is riveted on the casing 18 so that it is hard to detach the rivet 22 from the casing 18. Therefore, incase of damage of the fixing block 25, the housing and the stop member 20 must be also replaced along with the fixing block. This leads to waste of resource. Similarly, in case of damage of the stop member 20, the housing and the fixing block 25 must be also replaced along with the stop member 20.

Accordingly, the poor structural design of the conventional torque wrench 10 leads to higher cost for replacement of the components and deterioration of the precision of the torque value and needs to be improved.

SUMMARY OF THE INVENTION

It is therefore a primary object of the present invention to provide a collapsible torque wrench, in which the components can be easily replaced without wasting.

It is a further object of the present invention to provide the above collapsible torque wrench, in which the components are assembled in such a manner that the components will not over-abrade each other so as to ensure the precision of the torque value of the wrench.

The collapsible torque wrench of the present invention includes:

a shank, a drive head being disposed at a front end of the shank, two pivoted end being disposed at a rear end of the shank;

a connection rod, a front end of the connection rod being pivotally connected with a first pivoted end of the shank, whereby the connection rod is angularly displaceable relative to the shank;

a housing having a tubular body and a casing fixedly disposed on one side of the tubular body, the connection rod being relatively slidably fitted in the tubular body, at least two pinholes being formed on a circumference of the tubular body;

a torque adjustment mechanism including a fixing block, at least one elastic member and an adjustment member; the fixing block being a hollow sleeve, and being mounted in the tubular body with at least two pin members; a front end of the adjustment member being screwed with the rear end of the connection rod; the elastic member being mounted in the tubular body, two ends of the elastic member respectively abutting against the fixing block and the adjustment member; and a stop member, a body of the stop member being formed with a locating slot, the stop member being received in the casing, a front end of the stop member being pivotally connected with a second pivoted end of the shank, whereby the stop member is angularly displaceable within the casing; a restriction member being disposed in the casing to extend into the locating slot of the stop member; and the first pivoted end of the shank and the front end of the connection rod form a sandwich pivot structure including two lugs spaced from each other and a middle section positioned between the two lugs; a through hole passing through the two lugs; a pivot hole being disposed on the middle section; a relatively soft collar being mounted in the pivot hole; a pivot pin being fitted through the through hole of the two lugs and the pivot hole of the middle section; at least one end of the pivot pin being tightened with a wall of the through hole of at least one of the two lugs; the collar being positioned between the pivot pin and the pivot hole.

The relatively soft member is mounted in the pivot portion between the shank and the connection rod, so that the gap between the shank and the connection rod is minimized and the wear thereof is reduced. The precision of the torque value of the torque wrench can be ensured.

Accordingly, the fixing block is demountably/removably mounted in the tubular body, and can be easily replaced. The installation of the fixing block will not cause deformation of the fixing block.

Preferably, the restriction member is an insertion pin for replacement of the stop member.

The present invention can be best understood through the following description and accompanying drawings, wherein:

DETAILED DESCRIPTION OF THE PREFERRED EMBODIMENTS

Figure 1:
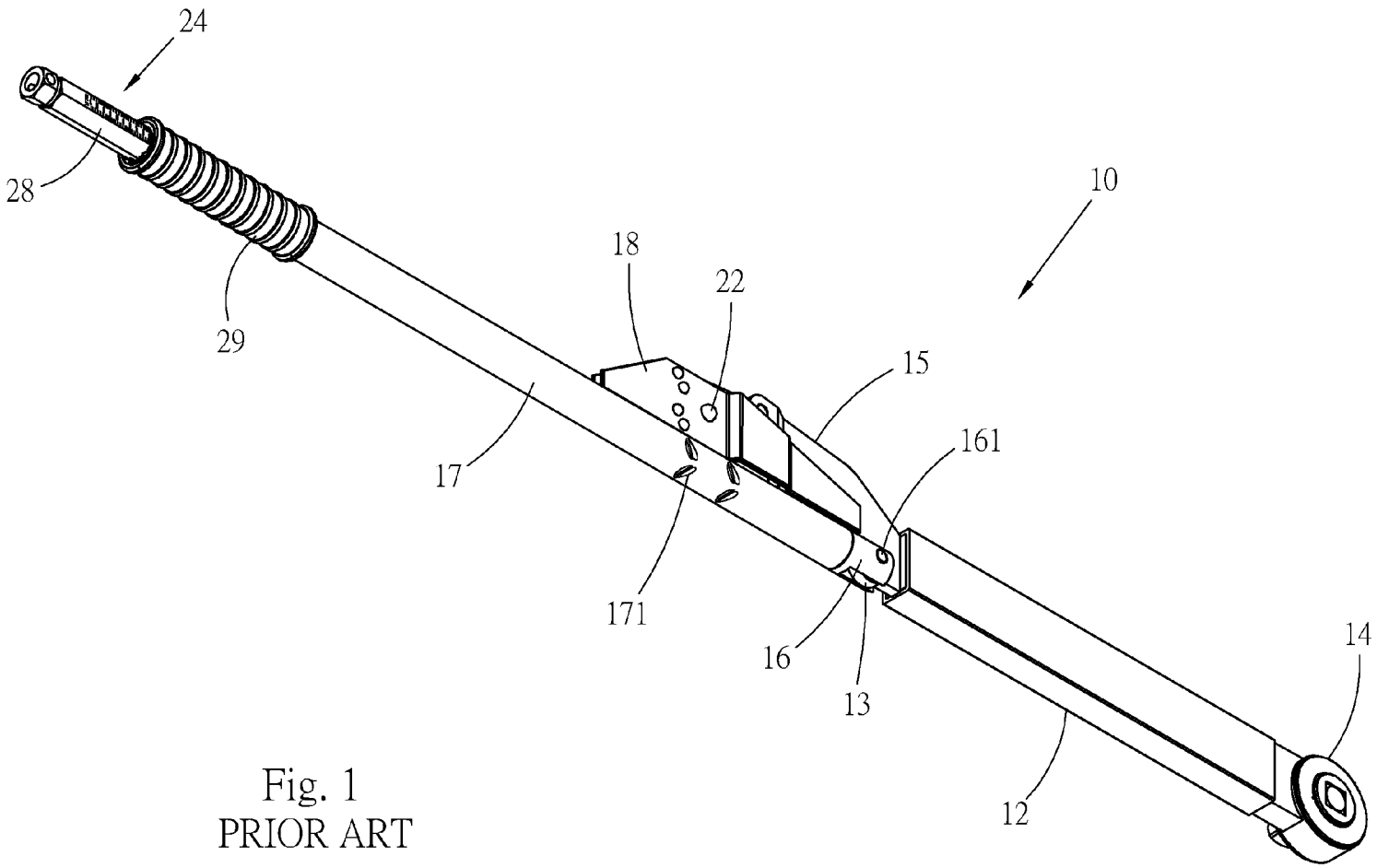
Fig. 1 PRIOR ART
FIG. 1 is a perspective view of a conventional torque wrench.
Figure 2:
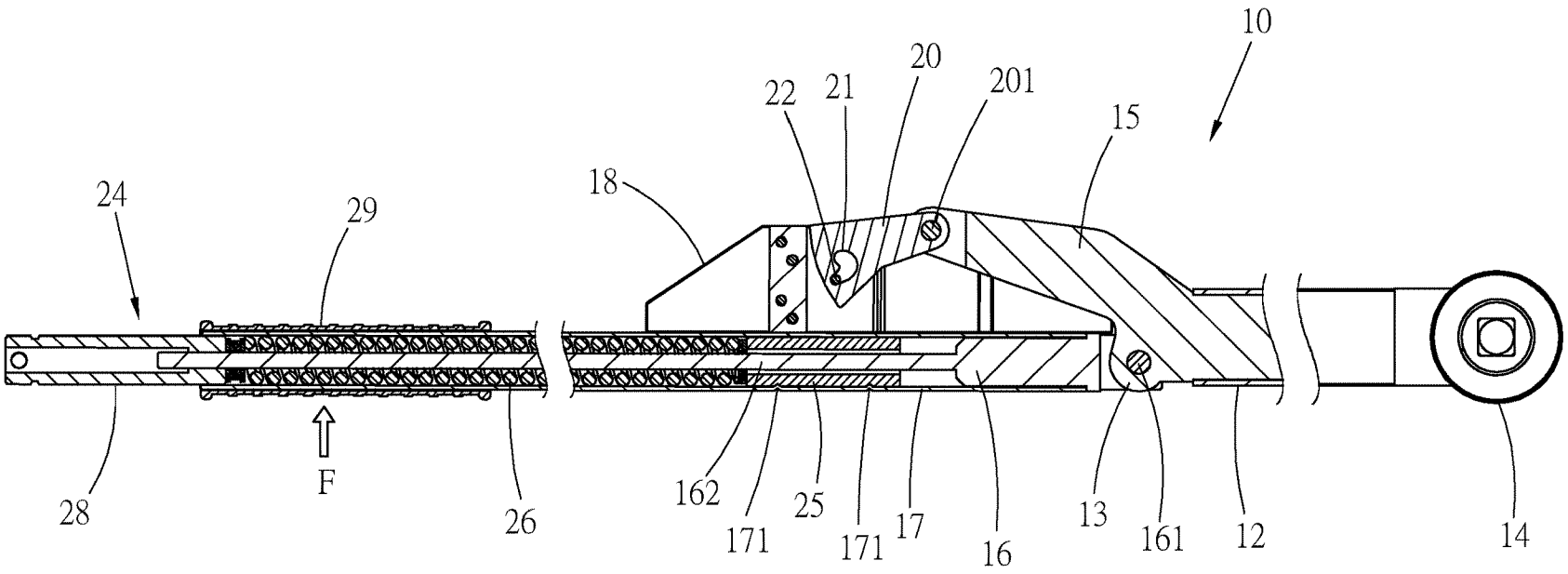
Fig. 2 PRIOR ART
FIG. 2 is a longitudinal sectional view according to FIG. 1.
Figure 3:
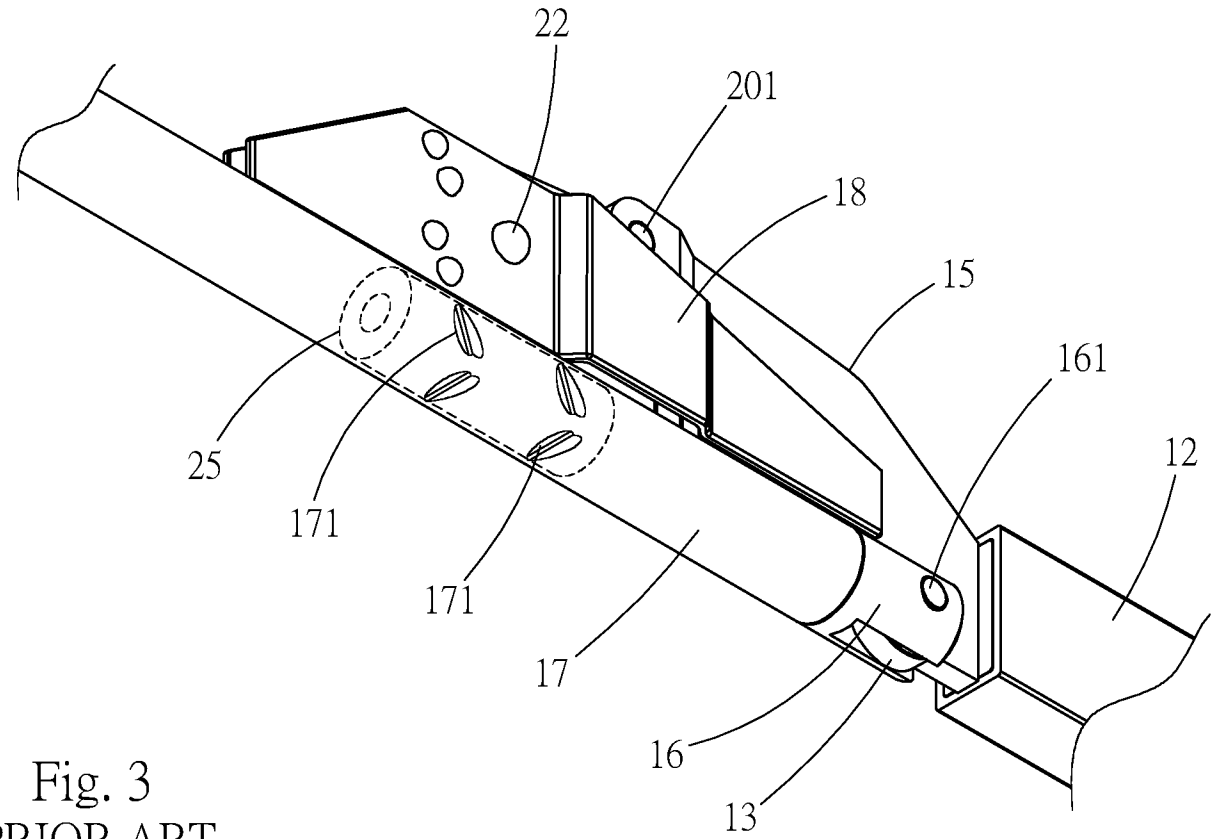
Fig. 3 PRIOR ART
FIG. 3 is an enlarged view of a part of FIG. 1.
Figure 4:
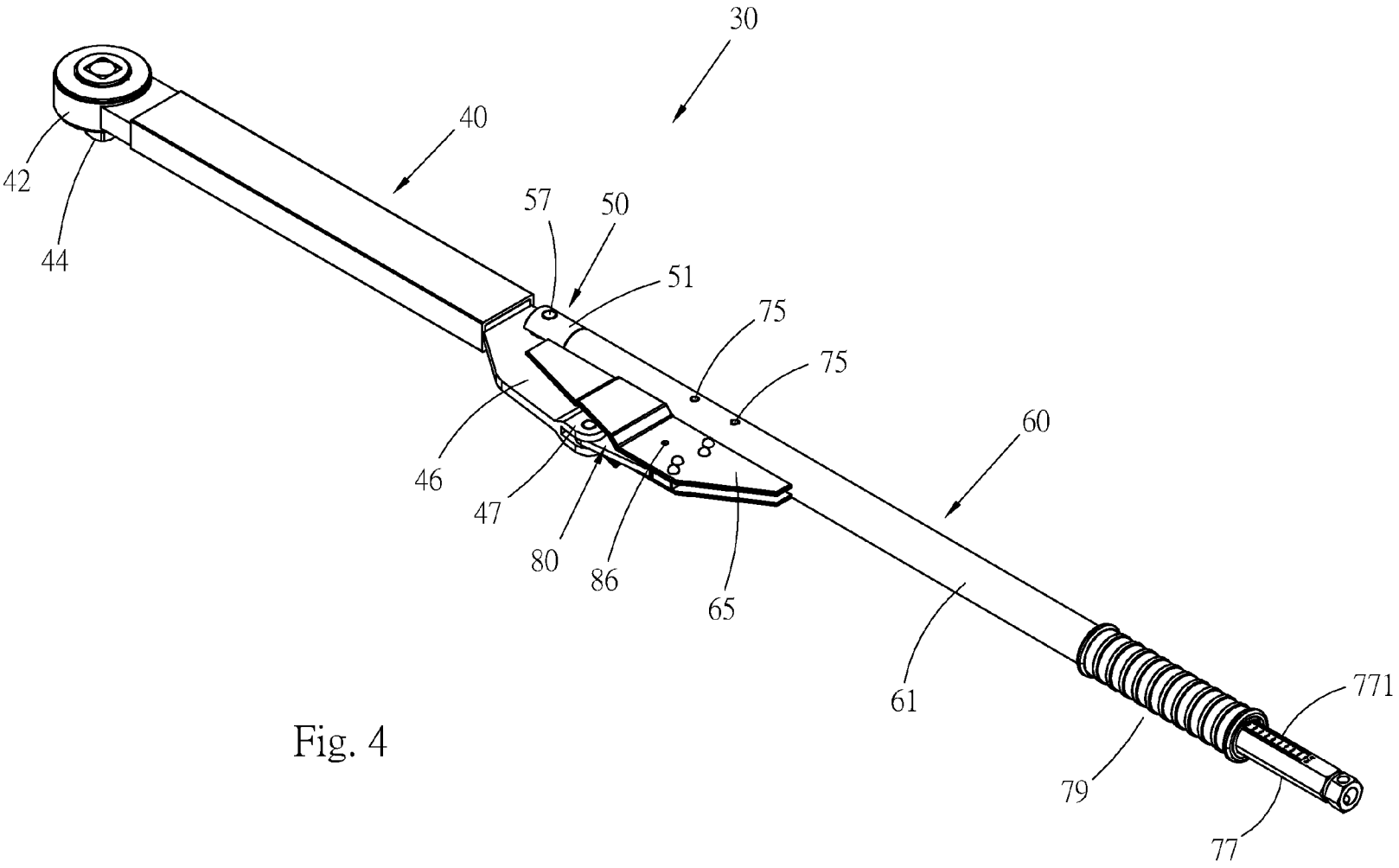
FIG. 4 is a perspective assembled view of a preferred embodiment of the torque wrench of the present invention.
Figure 5:
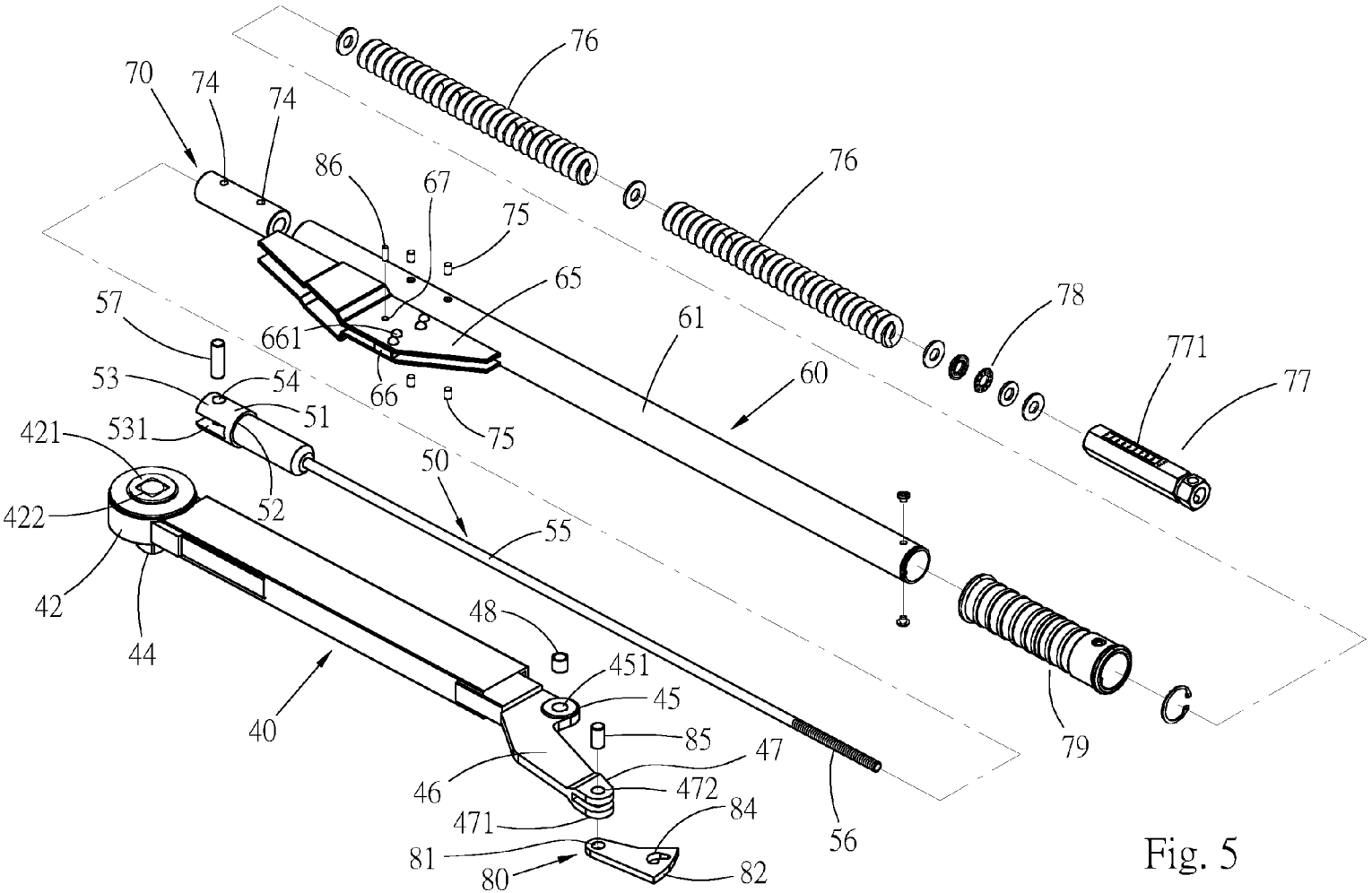
FIG. 5 is a perspective exploded view of the preferred embodiment of the torque wrench of the present invention.
Figure 6:
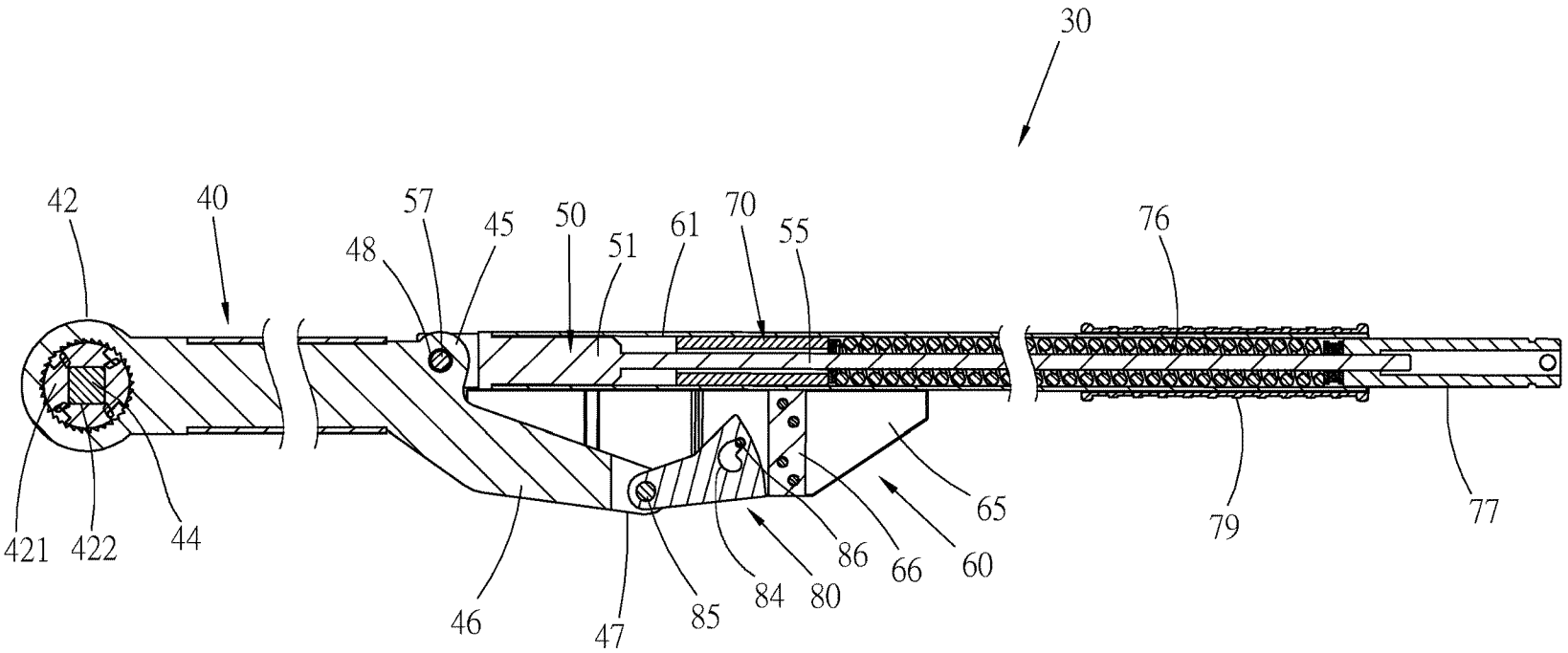
FIG. 6 is a longitudinal sectional view according to FIG. 4.

Please refer to FIGS. 4 to 6. According to a preferred embodiment, the collapsible torque wrench 30 of the present invention includes a shank 40. A drive head 42 is disposed at a front end of the shank 40. In this embodiment, the drive head 42 is a ratchet structure having a ratchet wheel 421. The ratchet wheel 421 is formed with a quadrangular fitting hole 422. An insertion pin 44 is inserted in the fitting hole 422 and elastically located therein. The insertion pin 44 is inserted in a socket (not shown) to connect the drive head 42 with the socket. The socket is fitted onto a threaded member to wrench the same. The form of the drive head 42 is not limited to the above embodiment. A first pivoted end 45 is disposed at a rear end of the shank 40. The shank 40 further has a branch bar 46 laterally extending from the rear end of the shank. A rear end of the branch bar 46 forms a second pivoted end 47 of the shank. The second pivoted end 47 has the form of two lugs 471; a hole 472 extends through the two lugs 471. The first and second pivoted ends 45 and 47 are spaced from each other.

The collapsible torque wrench 30 of the present invention further includes a connection rod 50 having a large-diameter section 51 at a front end and a slender rod section 55 fixedly connected with a rear end of the large-diameter section 51. A shoulder section 52 is disposed on a circumference of the large-diameter section 51. Two lugs 53 are disposed at a front end of the large-diameter section 51 and spaced from each other. The two lugs define therebetween a split 531. A through hole 54 extends through the two lugs 53. A circumference of a rear end of the slender rod section 55 is formed with a thread 56. The front end of the connection rod 50 is pivotally connected with the pivoted end 45 of the shank 40. To speak more specifically, the pivoted end 45 is positioned in the split 531 between the two lugs 53 of the large-diameter section 51. The pivoted end 45 and the two lugs 53 together forma sandwich pivot structure. The pivoted end 45 serves as a middle section between the two lugs 53. A first pivot pin 57 is passed through the through hole 54 of the two lugs 53 and the pivot hole 451 of the pivoted end 45 to pivotally connect the shank 40 with the connection rod 50, whereby the shank 40 and the connection rod 50 are rotatable relative to each other. Please refer to FIGS. 7 and 8. In this embodiment, the pivot hole 451 of the pivoted end 45 has a diameter larger than that of the through hole 54 of the connection rod 50. A relatively soft collar such as a copper collar 48 is mounted in the pivot hole 451. The pivot pin 57 is fitted through the copper collar 48, a circumferential surface of one end of the pivot pin is tightened with the wall of the through hole 54 of one of the two lugs 53. For example, a circumferential surface of a top end of the pivot pin 57 is tightened with the wall of the through hole 54 of the upper lug. By one end of the pivot pin 57 tightening with one of the lugs 53, it is convenient to facilitate the installation of the pivot pin 57 and it is easy to pivotally connect the shaft 40 and the connecting rod 50. According to such structural design, the gap between the pivoted end 45 and the large-diameter section 51 is minimized. On the other hand, when the connection rod 50 is angularly displaced relative to the shank 40, the pivot pin 57 is rotated along with the connection rod 50. The copper collar 48 serves as a lubricant medium between the wall of the pivot hole 451 and the pivot pin 57. Under such circumstance, the rotation of the large-diameter section 51 relative to the pivoted end 45 is smoothened to avoid wear of the large-diameter section 51 and the pivoted end 45. In this case, the precision of the torque value of the torque wrench 30 can be ensured without deteriorating due to long-term use.

The collapsible torque wrench 30 of the present invention further includes a housing 60 having a tubular body 61 and a casing 65 fixedly disposed on one side of the tubular body. The connection rod 50 is relatively slidably fitted in the tubular body 61. A front end of the tubular body 61 is fitted around the large-diameter section 51 of the connection rod. The slender rod section 55 is positioned in the tubular body 61 to extend to a rear end of the tubular body. The casing 65 is composed of an upper plate body and a lower plate body, which are side by side arranged. The casing 65 has an internal receiving space. A block body 66 is fixed in the casing with rivets 661 to keep the two plate bodies spaced from each other by a fixed distance. Please refer to FIGS. 5 and 8. The circumference of the tubular body 61 is formed with two radial pinholes 62 passing through the tubular body 61 from the top to the bottom thereof. A second pinhole 67 is formed through the casing 65 from a top face to a bottom face thereof.

A torque adjustment mechanism is mounted in the tubular body 61, including a fixing block 70, at least one elastic member 76 and an adjustment member 77.

The fixing block 70 is a hollow sleeve having an internal axial passage 72. Two insertion holes 74 radially pass through the fixing block 70. The fixing block 70 is mounted in the tubular body 61 with the two insertion holes 74 aligned with the two pinholes 62 respectively. Four pin members 75 are respectively inserted in two ends of the two pinholes 62 of the tubular body 61 and two ends of the two insertion holes 74 of the fixing block 70 without passing through the fixing block so as to fix the fixing block 70 with the tubular body 61. The slender rod section 55 of the connection rod 50 extends through the passage 72 of the fixing block 70. A circumferential surface of each the pin member 75 is tightened with an insertion hole 74 of the fixing block 70 and a pinhole 62 of the tubular body 61, In this embodiment, the elastic member 76 is a compression spring mounted in the tubular body.

Figure 9:
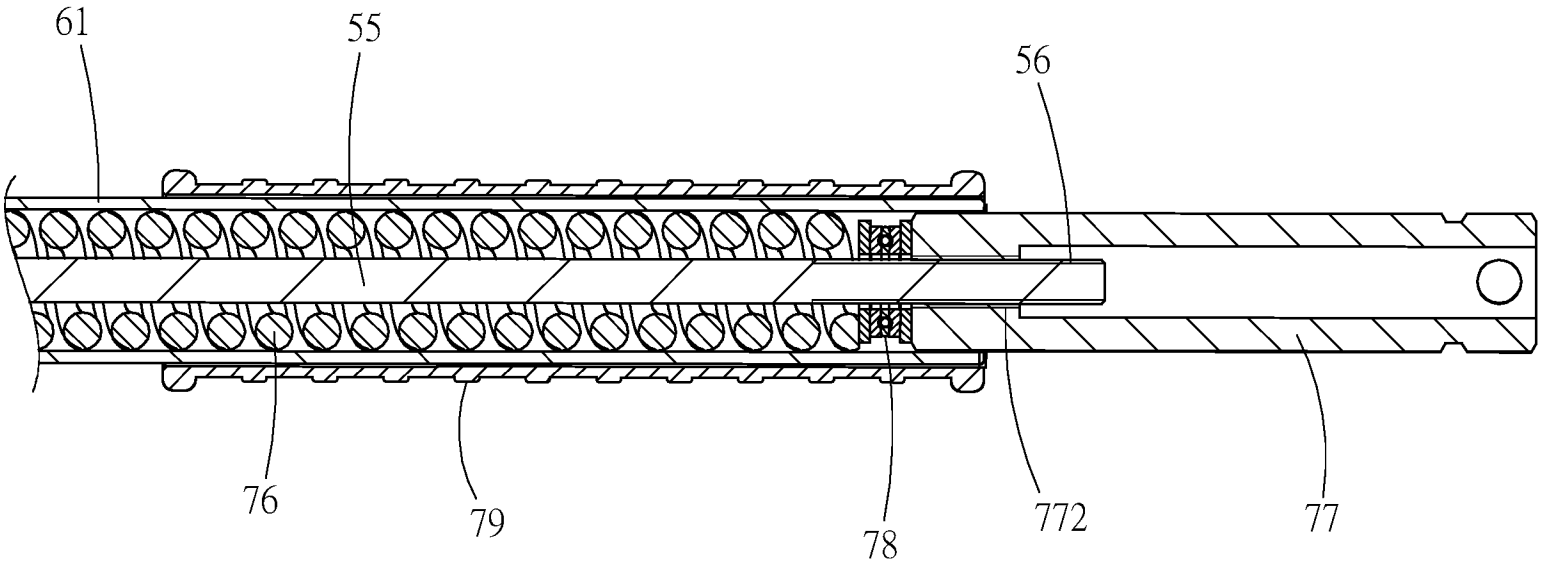
FIG. 9 is an enlarged view of a part of FIG. 6.

Please refer to FIGS. 5 and 9. The adjustment member 77 has the form of a bar. An outer circumference of the adjustment member 77 is longitudinally marked with scales 771. The adjustment member is formed with an internal axial threaded hole 772. The thread 56 of the rear end of the slender rod section 55 of the connection rod is screwed in the threaded hole 772. Most of the adjustment member 77 protrudes outward from the rear end of the tubular body 61. Two ends of the elastic member 76 respectively abut against the fixing block 70 and the adjustment member 77. When rotating the adjustment member 77, the adjustment member 77 is axially moved along the connection rod 50 to increase or decrease the elastic force of the elastic member 76. The torque of the wrench 30 can be adjusted by means of changing the elastic force of the elastic member 76. A user can read the scales 771 of the adjustment member 77 at the rear end of the tubular body 61 to know the torque value of the wrench. In practice, the elastic member 76 abuts against the adjustment member 77 via a bearing 78 so as to reduce the friction between the elastic member and the adjustment member. A handle 79 is disposed at the rear end of the tubular body 61 as a grip section for a user to operate the wrench.

Figure 11:
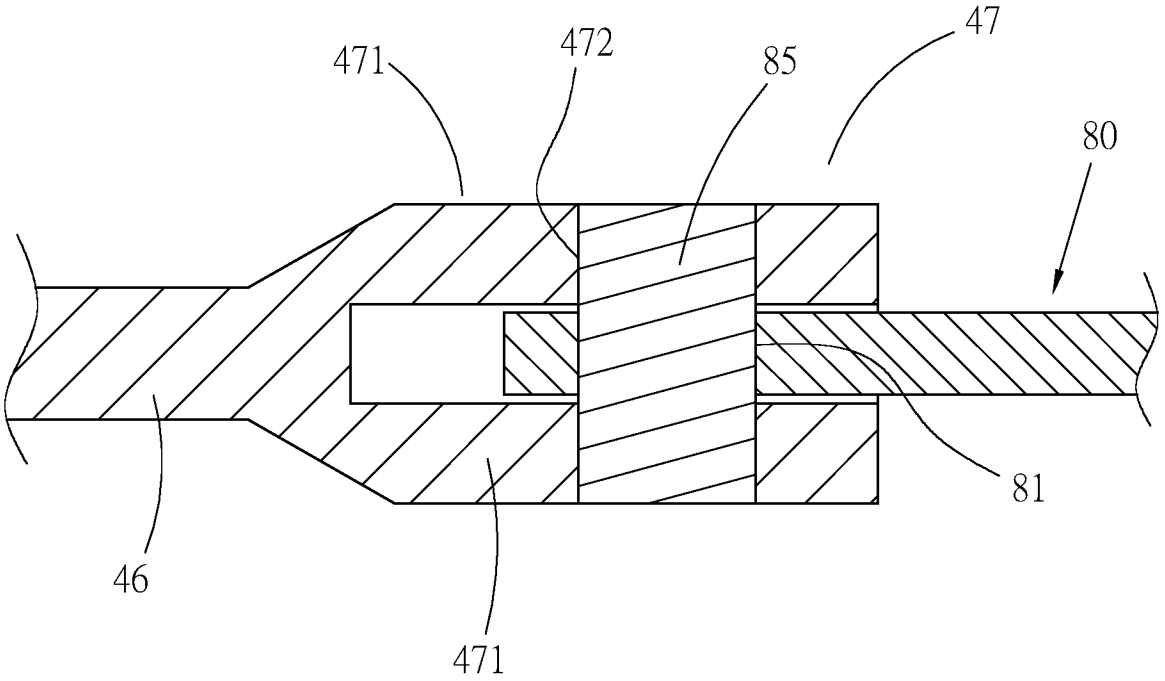
FIG. 11 is a sectional view taken along line 11-11 of FIG. 7

The collapsible torque wrench 30 of the present invention further includes a stop member 80 having a front end and a rear end. A hole 81 is formed on the front end of the stop member 80. The rear end of the stop member 80 is an arched end 82. The body of the stop member 80 is formed with an arched locating slot 84. The stop member is received in the casing 65. The front end of the stop member 80 is pivotally connected with the second pivoted end 47 of the branch bar 46 via a second pivot pin 85, as shown in FIG. 11, whereby the stop member 80 can be angularly displaced around the pivot pin 85. In installation, a circumferential surface of one end of the second pivot pin 85 is tightened with the wall of the hole 472 of one of the two lugs 471 of the second pivot end 47, for example, a circumferential surface of a top end of the pivot pin 85 is tightened with the wall of the hole 472 of the upper lug, it is easy to facilitate the installation of the pivot pin 85. A restriction member 86, which is an insertion pin, is inserted in the pinhole 67 of the casing 65 to extend into the locating slot 84 of the stop member 80. As necessary, the arched end 82 of the stop member can contact the block body 66 of the casing to provide stop effect.

Figure 7:
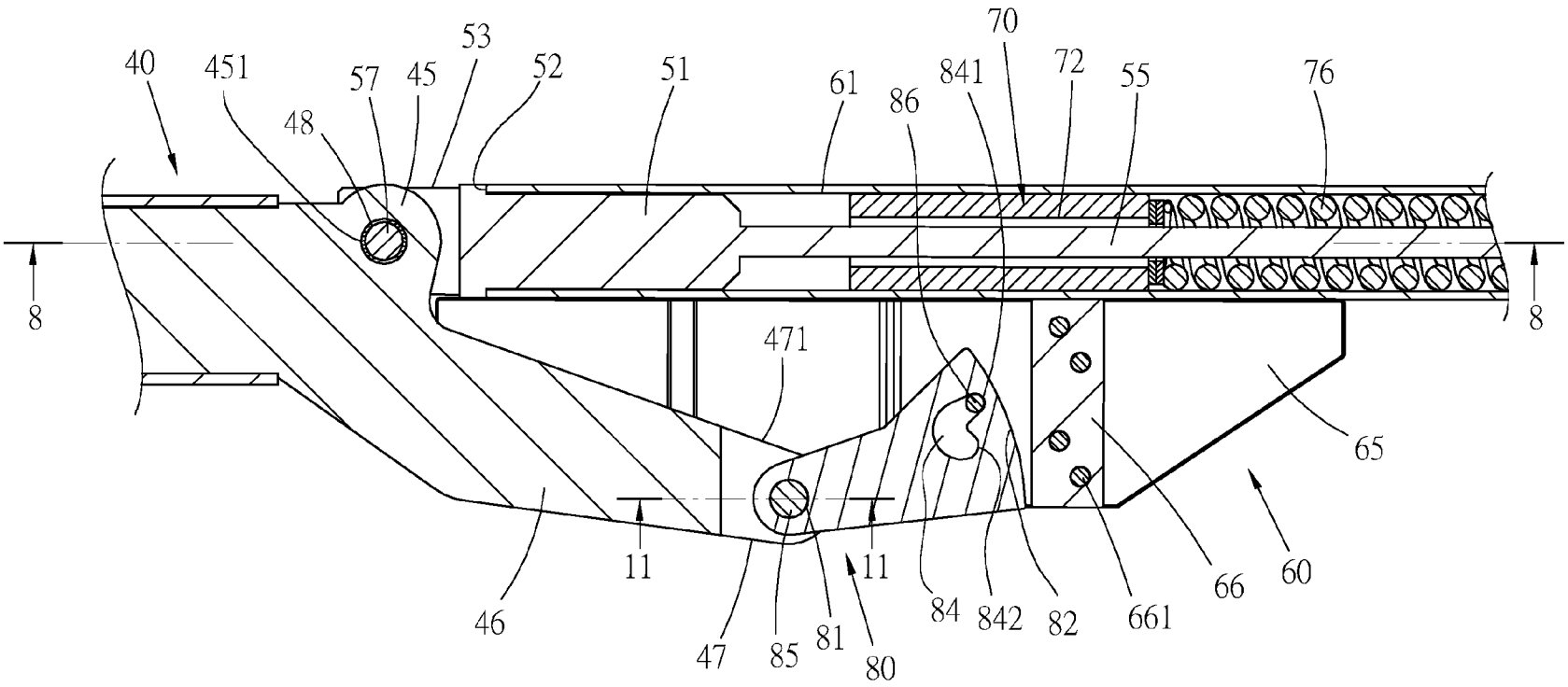
FIG. 7 is an enlarged view of a part of FIG. 6.
Figure 8:
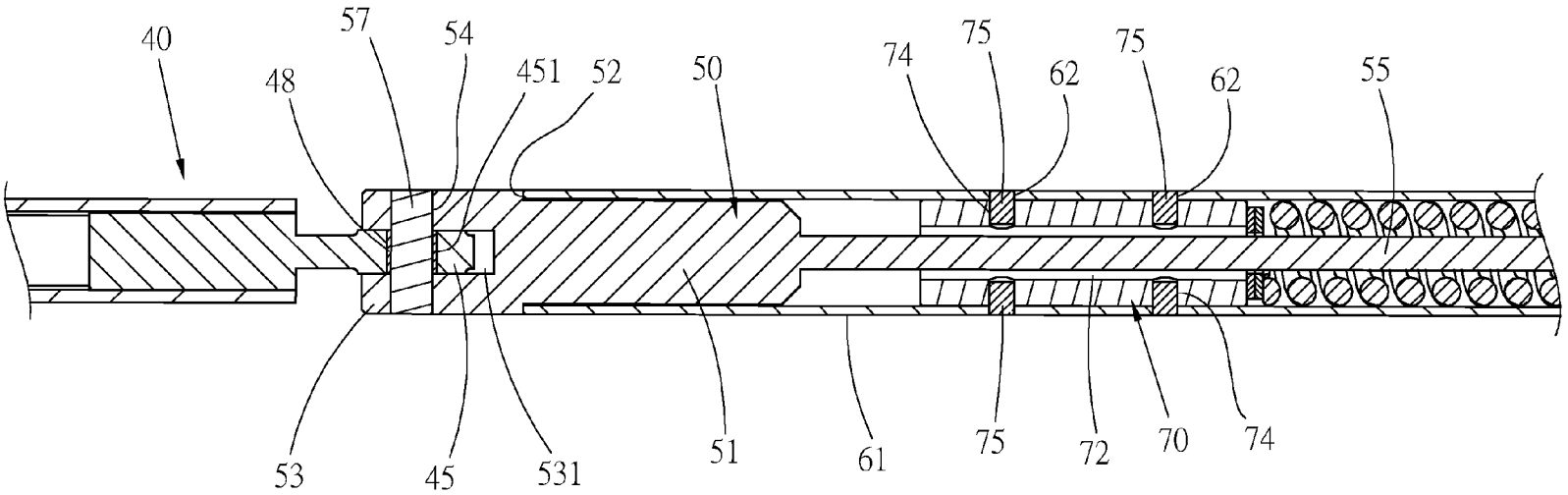
FIG. 8 is a sectional view taken along line 8-8 of FIG. 7.

As shown in FIGS. 6 and 7, in a normal state, the tubular body 61 is substantially parallel to the shank 40. The elastic member 76 provides an elastic force to push the housing 60 forward via the fixing block 70, whereby the front end of the tubular body 61 contacts the shoulder section 52 of the large-diameter section 51 of the connection rod 50 to locate the tubular body 61. At this time, the stop member 80 is positioned in a first angular position and the restriction member 86 is positioned in a first end 841 of the locating slot 84.

Figure 10:
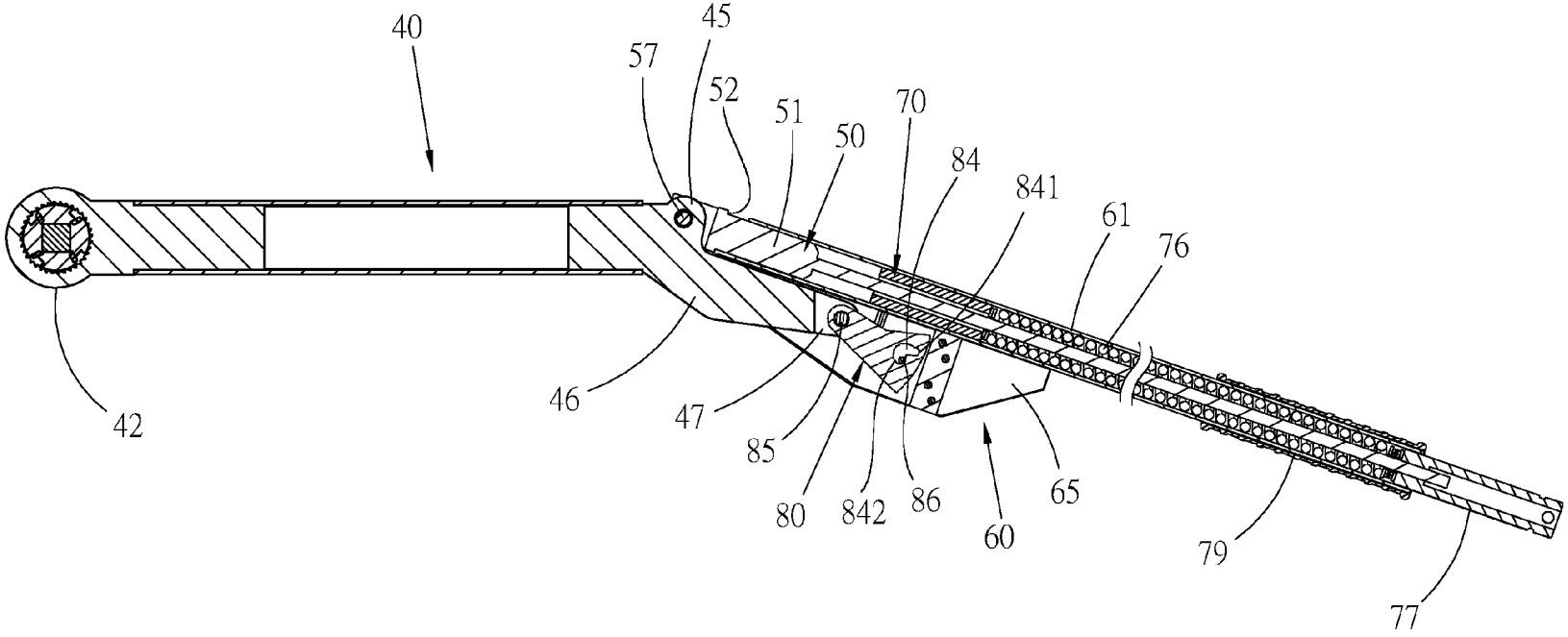
FIG. 10 is a longitudinal sectional view of the torque wrench of the present invention in a collapsed state.

In use of the wrench, a user holds the handle 79 to wrench a threaded member with the drive head 42 of the wrench. During the wrenching process, the housing 60 is moved backward and the front end of the tubular body 61 is separated from the shoulder section 52 of the large-diameter section 51. The fixing block 70 is moved along with the tubular body 61 to compress the elastic member 76. At this time, the stop member 20 is angularly displaced within the casing 65. In the case that the applied force exceeds the set torque of the wrench, the wrench is collapsed as shown in FIG. 10 to remind the user to stop wrenching. At this time, the components on rear side of the shank 40, that is, the housing 60, the connection rod 50, the stop member 80, etc., are laterally rotated around the pivot pins 57, 85 of the pivoted ends 45, 47. The stop member 80 is angularly displaced to a second angular position and the restriction member 86 is positioned in a second end 842 of the locating slot 84. Alternatively, when the wrench reaches the set torque, the tubular body 61 can abut against the branch bar 47 as a dead end of the rotating travel of the tubular body 61.

In the torque wrench of the present invention, at least two pin members 75 are used to fix the fixing block 70 in the tubular body 61. In the case that the fixing block 70 is damaged and needs to be replaced, a user only needs to take off the pin members 75 to separate the fixing block from the tubular body 61 and replace the fixing block 70 with a new one. Similarly, in case of damage of the stop member 80, the restriction member 86, that is, the insertion pin, can be easily taken off. After the restriction member 86 and the pivot pin 85 are removed, the stop member 80 can be replaced with a new one. Accordingly, in the structure of the present invention, in case of damage of any component, the component can be independently replaced without replacing any other component. This can save cost.

Moreover, the fixing block 70 is fixed with the tubular body 61 by means of the pin members 75 in such a manner that the fixing block 70 is not subject to deformation. Therefore, the slender rod section 55 of the connection rod 50 will not over-abrade the fixing block 70. Under such circumstance, the smoothness of the operation of the wrench mechanism is enhanced and the precision of the torque value of the wrench is ensured.

In addition, the copper collar 48 is mounted in the pivot hole 451 and the pivot pin 57 is fitted through the copper collar 48 with two ends tightened with the wall of the through hole 54. Accordingly, the gap between the shank and the connection rod is minimized and the wear thereof is reduced. In this case, the precision of the torque value of the torque wrench can be ensured even after a long-term use.

The above embodiments are only used to illustrate the present invention, not intended to limit the scope thereof. Many modifications of the above embodiments can be made without departing from the spirit of the present invention.

What is claimed is:

1. A collapsible torque wrench comprising:

a shank; a drive head being disposed at a front end of the shank; a first pivoted end and a second pivoted end being disposed at a rear end of the shank and spaced from each other by a certain distance;

a connection rod, a front end of the connection rod being pivotally connected with the first pivoted end of the shank, whereby the connection rod is angularly displaceable relative to the shank;

a housing having a tubular body and a casing fixedly disposed on one side of the tubular body, the connection rod being relatively slidably fitted in the tubular body, a rear end of the connection rod extending into the tubular body; at least two pinholes being formed on a circumference of the tubular body; the casing having an internal receiving space;

a torque adjustment mechanism including a fixing block, at least one elastic member and an adjustment member;

the fixing block being a hollow sleeve; at least two insertion holes being radially formed on a circumference of the fixing block; the fixing block being mounted in the tubular body; a predetermined number of pin members being respectively inserted in the pinholes of the tubular body and the insertion holes of the fixing block to fix the fixing block with the tubular body; the rear end of the connection rod extending through the fixing block;

a front end of the adjustment member being screwed with the rear end of the connection rod;

the elastic member being mounted in the tubular body, two ends of the elastic member respectively abutting against the fixing block and the adjustment member;

a stop member, a body of the stop member being formed with a locating slot, the stop member being received in the casing, a front end of the stop member being pivotally connected with the second pivoted end of the shank, whereby the stop member is angularly displaceable within the casing; a restriction member being disposed in the casing to extend into the locating slot of the stop member; and the first pivoted end of the shank and the front end of the connection rod form a sandwich pivot structure including two lugs spaced from each other and a middle section positioned between the two lugs; a through hole passing through the two lugs; a pivot hole being disposed on the middle section, the pivot hole having a diameter larger than that of the through hole; a relatively soft collar being mounted entirely in the pivot hole; a pivot pin being fitted through the through hole of the two lugs and the pivot hole of the middle section; at least one end of the pivot pin being secured with a wall of the through hole of at least one of the two lugs; the collar being positioned between the pivot pin and the pivot hole and located between the two lugs.

2. The torque wrench as claimed in claim 1, wherein the two pinholes pass through the tubular body and the two insertion holes pass through the fixing block, two ends of the two pinholes being respectively aligned with two ends of the two insertion holes; at least four pin members being respectively inserted in one end of each pinhole and one end of each insertion hole aligned with the pinhole.

3. The torque wrench as claimed in claim 1, wherein a second pinhole is formed through the casing from a top face to a bottom face thereof; the restriction member being an insertion pin inserted in the second pinhole and extending into the locating slot of the stop member.

4. The torque wrench as claimed in claim 1, wherein a branch bar is disposed on one side of the shank; the first pivoted end being disposed at the rear end of the shank, while the second pivoted end being disposed on the branch bar.

5. The torque wrench as claimed in claim 1, wherein the connection rod has a large-diameter section; the tubular body being fitted around the large-diameter section.

6. The torque wrench as claimed in claim 1, wherein the collar is a copper collar.

7. The torque wrench as claimed in claim 1, wherein the fixing block being formed with an axial passage; the connection rod having a large-diameter section and a slender rod section connected with a rear end of the large-diameter section; a shoulder section being disposed on a circumference of the large-diameter section; the slender rod section of the connection rod passing through the passage of the fixing block; the adjustment member being screwed with the rear end of the slender rod section; the tubular body being fitted around the large-diameter section of the connection rod, a front end of the tubular body being contactable with the shoulder section; a circumference of the adjustment member being marked with scales, the adjustment member partially protruding outward from the rear end of the tubular body.

* * * * *